US007123875B1

(12) United States Patent
Marko et al.

(10) Patent No.: US 7,123,875 B1
(45) Date of Patent: Oct. 17, 2006

(54) SYSTEM AND METHOD FOR MULTIPOINT DISTRIBUTION OF SATELLITE DIGITAL AUDIO RADIO SERVICE

(75) Inventors: Paul D. Marko, Pembrone Pines, FL (US); Craig Wadin, Sunrise, FL (US)

(73) Assignee: XM Satellite Radio, Inc., Washington, DC (US)

( * ) Notice: Subject to any disclaimer, the term of this patent is extended or adjusted under 35 U.S.C. 154(b) by 0 days.

(21) Appl. No.: 09/435,315

(22) Filed: Nov. 4, 1999

(51) Int. Cl.
*H04H 1/00* (2006.01)

(52) U.S. Cl. ..... 455/3.02; 455/13.1; 455/18; 455/3.01

(58) Field of Classification Search ..... 455/277.1, 455/402, 270, 562, 522, 12.1, 13.2, 13.1, 455/20, 42, 63, 11.1, 16, 17, 21, 22, 23, 426.2, 455/429, 430, 3.01, 3.02, 3.03, 18, 427; 370/320, 370/477, 204, 229; 375/229
See application file for complete search history.

(56) References Cited

U.S. PATENT DOCUMENTS 4,901,307 A * 2/1990 Gilhousen et al. ..... 370/320
5,771,436 A * 6/1998 Ikehama ..... 348/14.08
5,809,431 A * 9/1998 Bustamante ..... 455/562
6,055,268 A * 4/2000 Timm et al. ..... 375/229
6,061,562 A * 5/2000 Martin et al. ..... 455/431
6,091,932 A * 7/2000 Langlais ..... 725/111
6,154,452 A * 11/2000 Marko et al. ..... 455/13.1
6,178,330 B1 * 1/2001 Alberty et al. ..... 370/477
6,243,427 B1 * 6/2001 Stockton et al. ..... 375/308
6,272,328 B1 * 8/2001 Nguyen et al. ..... 455/277.1
6,301,232 B1 * 10/2001 Dutta ..... 370/321
6,308,080 B1 * 10/2001 Burt et al. ..... 455/522
6,366,326 B1 * 4/2002 Ozkan et al. ..... 348/558
6,424,817 B1 * 7/2002 Hadden et al. ..... 455/3.02
6,456,823 B1 * 9/2002 Black ..... 455/3.01
6,519,446 B1 * 2/2003 Tawil et al. ..... 455/3.02
6,560,213 B1 * 5/2003 Izadpanah et al. ..... 370/338
6,618,384 B1 * 9/2003 Elliott ..... 370/396
6,724,827 B1 * 4/2004 Patsiokas et al. ..... 370/316
6,816,704 B1 * 11/2004 Fukuda ..... 455/7

* cited by examiner

*Primary Examiner*—Edward Urban
*Assistant Examiner*—John J. Lee
(74) *Attorney, Agent, or Firm*—Benman Brown&Williams

(57) ABSTRACT

A satellite digital audio radio service multipoint distribution system and method. The system comprises a satellite antenna and a satellite receiver for receiving a satellite digital audio radio signal and distributing a converted signal in response thereto. The distributed signal is received by plural receivers each of which provides a respective output signal in response thereto. In the best mode, the satellite receiver is a terrestrial repeater. The repeater decodes a stream of data received from the satellite and recodes the stream using a satellite radio terrestrial broadcast format. In the best mode, the signal is an intermediate frequency signal in the XM radio, multi-carrier modulation format. The recoded signal is rebroadcast by the repeater via a distribution network and received by a plurality of intermediate frequency (IF) receivers. The distribution system may be wireless, cable, or fiber optic. In the illustrative embodiment, the IF receivers are modified conventional satellite digital audio service receivers. A user interface is provided for each IF receiver to allow for channel selection and audio processing.

16 Claims, 5 Drawing Sheets

SYSTEM AND METHOD FOR MULTIPOINT DISTRIBUTION OF SATELLITE DIGITAL AUDIO RADIO SERVICE

BACKGROUND OF THE INVENTION

1. Field of the Invention

The present invention relates to communications systems. More specifically, the present invention relates to satellite digital audio service (SDARS) receiver architectures.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Satellite radio operators will soon provides digital quality radio broadcast services covering the entire continental Unites States. These services intend to offer approximately 100 channels, on which nearly 50 channels will provide music with the remaining stations offering news, sports, talk and data channels. According to C. E. Unterberg, Towbin, satellite radio has the capability to revolutionize the radio industry, in the same manner that cable and satellite television revolutionized the television industry.

Satellite radio has the ability to improve terrestrial radio's potential by offering a better audio quality, greater coverage and fewer commercials. Accordingly, in October of 1997, the Federal Communications Commission (FCC) granted two national satellite radio broadcast licenses. The FCC allocated 25 megahertz (MHz) of the electro-magnetic spectrum for satellite digital broadcasting, 12.5 MHz of which are owned by CD Radio and 12.5 MHz of which are owned by the assignee of the present application "XM Satellite Radio Inc." The FCC further mandated the development of interoperable receivers for satellite radio reception, i.e. receivers capable of processing signals from either CD Radio or XM Radio broadcasts. The system plan for each licensee presently includes transmission of substantially the same program content from two or more geosynchronous or geostationary satellites to both mobile and fixed receivers on the ground. In urban canyons and other high population density areas with limited line-of-sight (LOS) satellite coverage, terrestrial repeaters will broadcast the same program content in order to improve coverage reliability. Some mobile receivers will be capable of simultaneously receiving signals from two satellites and one terrestrial repeater for combined spatial, frequency and time diversity, which provides significant mitigation against multipath and blockage of the satellite signals.

In accordance with XM Radio's unique scheme, the 12.5 MHz band will be split into 6 slots. Four slots will be used for satellite transmission. The remaining two slots will be used for terrestrial re-enforcement. Each of two geostationary Hughes 702 satellites will transmit identical or at least similar program content. The signals transmitted with QPSK modulation from each satellite (hereinafter satellite1 and satellite2) will be time interleaved to lower the short-term time correlation and to maximize the robustness of the signal. For reliable reception, the LOS signals transmitted from satellite1 are received, reformatted to Multi-Carrier Modulation (MCM) and rebroadcast by non-line-of-sight (NLOS) terrestrial repeaters. The assigned 12.5 MHz bandwidth (hereinafter the "XM" band) is partitioned into two equal ensembles or program groups A and B. The use of two ensembles allows 4096 Mbits/s of total user data to be distributed across the available bandwidth. Each ensemble with be transmitted by each satellite on a separate radio frequency (RF) carrier. Each RF carrier supports up to 50 channels of music or data in Time Division Multiplex (TDM) format. With terrestrial repeaters transmitting an A and a B signal, six total are provided, each slot being centered at a different RF carrier frequency. The use of two ensembles also allows for the implementation of a novel frequency plan which affords improved isolation between the satellite signals and the terrestrial signal when the receiver is located near the terrestrial repeater.

Although satellite digital audio radio service was originally conceived for reception via a plurality of independently mobile receivers, the need has been recognized in the art for a system and method for distributing satellite digital audio radio service to a plurality of receivers that are not independently mobile relative to each other. One such application, by way of example, might involve the distribution of the SDARS content throughout a passenger airliner. Another application might involve the distribution of SDARS content throughout an office or apartment building.

SUMMARY OF THE INVENTION

The need in the art is addressed by the satellite digital audio radio service multipoint distribution system and method of the present invention. Generally, the inventive system comprises a first arrangement for receiving the satellite digital audio radio signal and distributing a converted signal in response thereto. The distributed signal is received by plural receivers each of which provide a respective output signal in response thereto.

In the illustrative embodiment, the first arrangement includes a satellite antenna and a radio frequency (RF) satellite receiver. In the best mode, the RF satellite receiver is a terrestrial repeater. The repeater decodes a stream of data received from the satellite and recodes the stream using a satellite radio terrestrial broadcast. In the best mode, the signal is an intermediate frequency signal in the XM radio, multi-carrier modulation (MCM) format.

The recorded signal is rebroadcast by the repeater via a distribution network and received by a plurality of intermediate frequency (IF) receivers. The distribution system may be wireless, cable, or fiber optic. In the illustrative embodiment, the IF receivers are modified conventional satellite digital audio radio service receivers. A user interface is provided for each IF receiver to allow for channel selection and audio processing.

As an alternative to the repeater, satellite radio signals may be stored in a medium such as a digital video disc and rebroadcast therefrom as disclosed and claimed in copending U.S. patent application Ser. No. 09/423,862, filed Nov. 4, 1999 by C. Wadin and P. Marko and entitled Composite Waveform Storage and Playback (Atty. Docket #39253) the teachings of which are incorporated herein by reference.

DESCRIPTION OF THE INVENTION

Illustrative embodiments and exemplary applications will now be described with reference to the accompanying drawings to disclose the advantageous teachings of the present invention.

Figure 1:
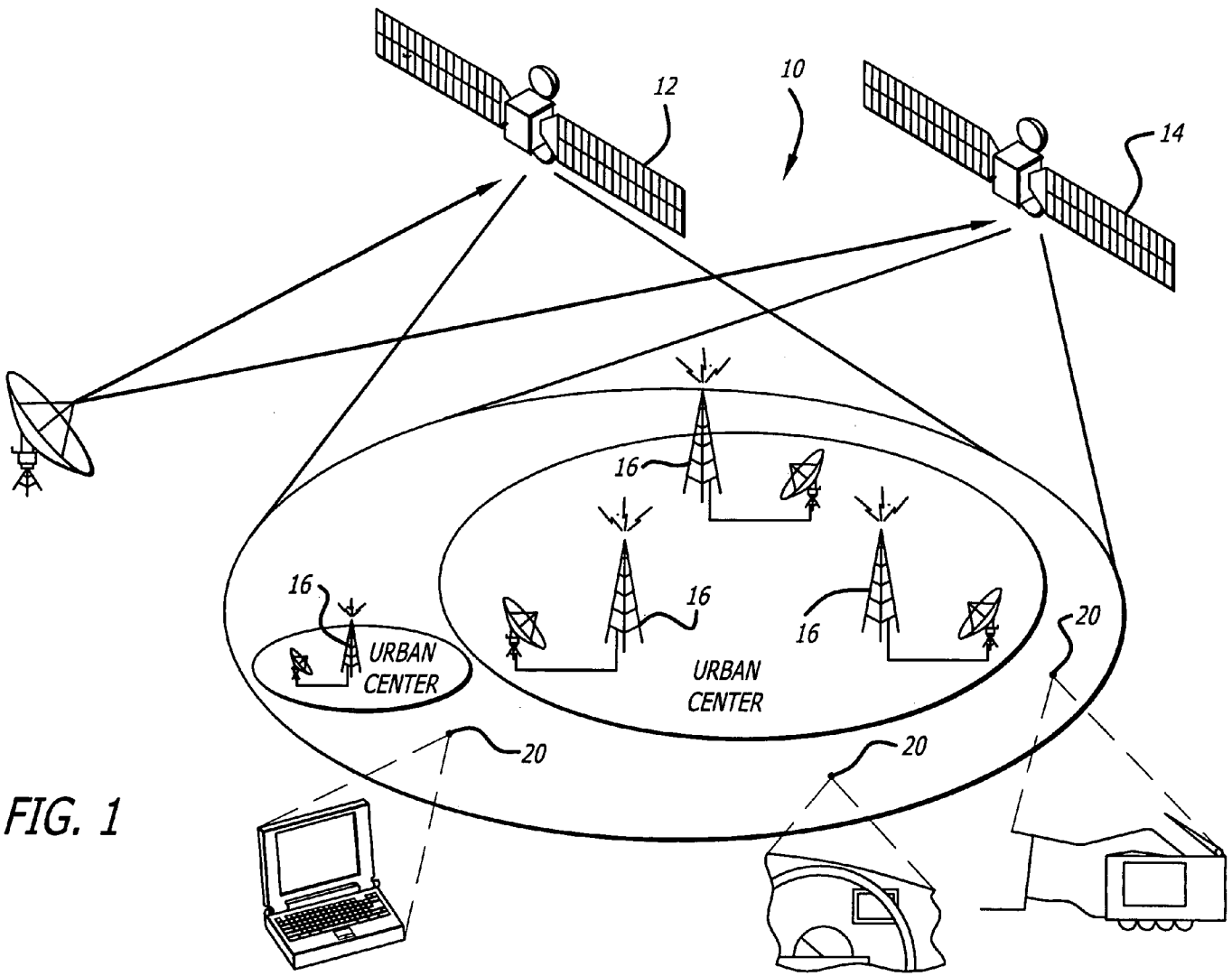
FIG. 1 illustrates a conventional implementation of a satellite digital audio radio service system architecture.

Conventional implementation of a satellite digital audio service (SDARS) system architecture is depicted in FIG. 1. The system 10 includes first and second geostationary satellites 12 and 14 which transmit line-of-sight (LOS) signals to SDARS receivers located on the surface of the earth. The satellites provide frequency and spatial diversity. The system 10 further includes plural terrestrial repeaters 16 which receive and retransmit the satellite signals to facilitate reliable reception in geographic areas where LOS reception from the satellites is obscured by tall buildings, hills, tunnels and other obstructions. The signals transmitted by the satellites 12 and 14 and the repeaters 16 are received by SDARS receivers 20. As depicted in FIG. 1, the receivers 20 may be located in automobiles, handheld or stationary units for home or office use. The SDARS receivers 20 are conventionally designed to receive one or both of the satellite signals and the signals from the terrestrial repeaters and combine or select one of the signals as the receiver output as discussed more fully below.

Figure 2:
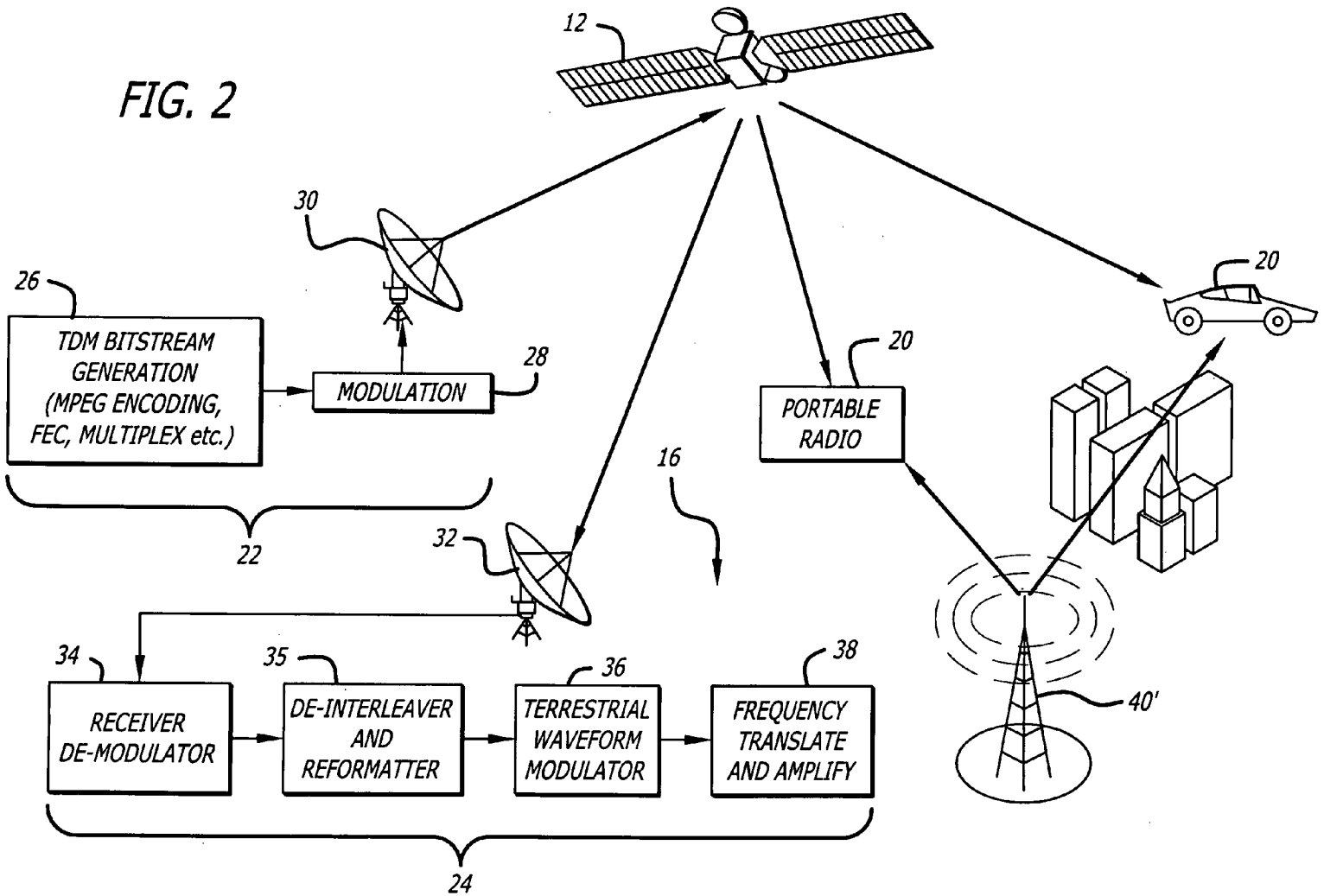
FIG. 2 is a diagram which illustrates the system of FIG. 1 in greater detail.

FIG. 2 is a diagram which illustrates the system 10 of FIG. 1 in greater detail with a single satellite and a single terrestrial repeater. FIG. 2 shows a broadcast segment 22 and a terrestrial repeater segment 24. In the preferred embodiment, an incoming bit stream is encoded into a time division multiplexed (TDM) signal using a code scheme (such as MPEG) by an encoder 26 of conventional design. The TDM bit stream is upconverted to RF by a conventional quadrature phase-shift keyed (QPSK) modulator 28. The upconverted TDM bit stream is then uplinked to the satellites 12 and 14 by an antenna 30. Those skilled in the art will appreciate that the present invention is not limited to the broadcast segment shown. Other systems may be used to provide signals to the satellites without departing from the scope of the present teachings.

The satellites 12 and 14 act as bent pipes and retransmit the uplinked signal to terrestrial repeaters 18 and receivers 20. As illustrated in FIG. 2, the terrestrial repeater 16 includes a receiver demodulator 34, a de-interleaver and reformatter 35, a terrestrial waveform modulator 36 and a frequency translator and amplifier 38. The receiver and demodulator 34 down-converts the downlinked signal to a TDM bitstream. The de-interleaver and reformatter 35 reorders the TDM bitstream for the terrestrial waveform. The digital baseband signal is then applied to a terrestrial waveform modulator 36 (e.g., MCM or multiple carrier modulator) and then frequency translated to a carrier frequency prior to transmission via a terrestrial antenna 40.

Figure 3:
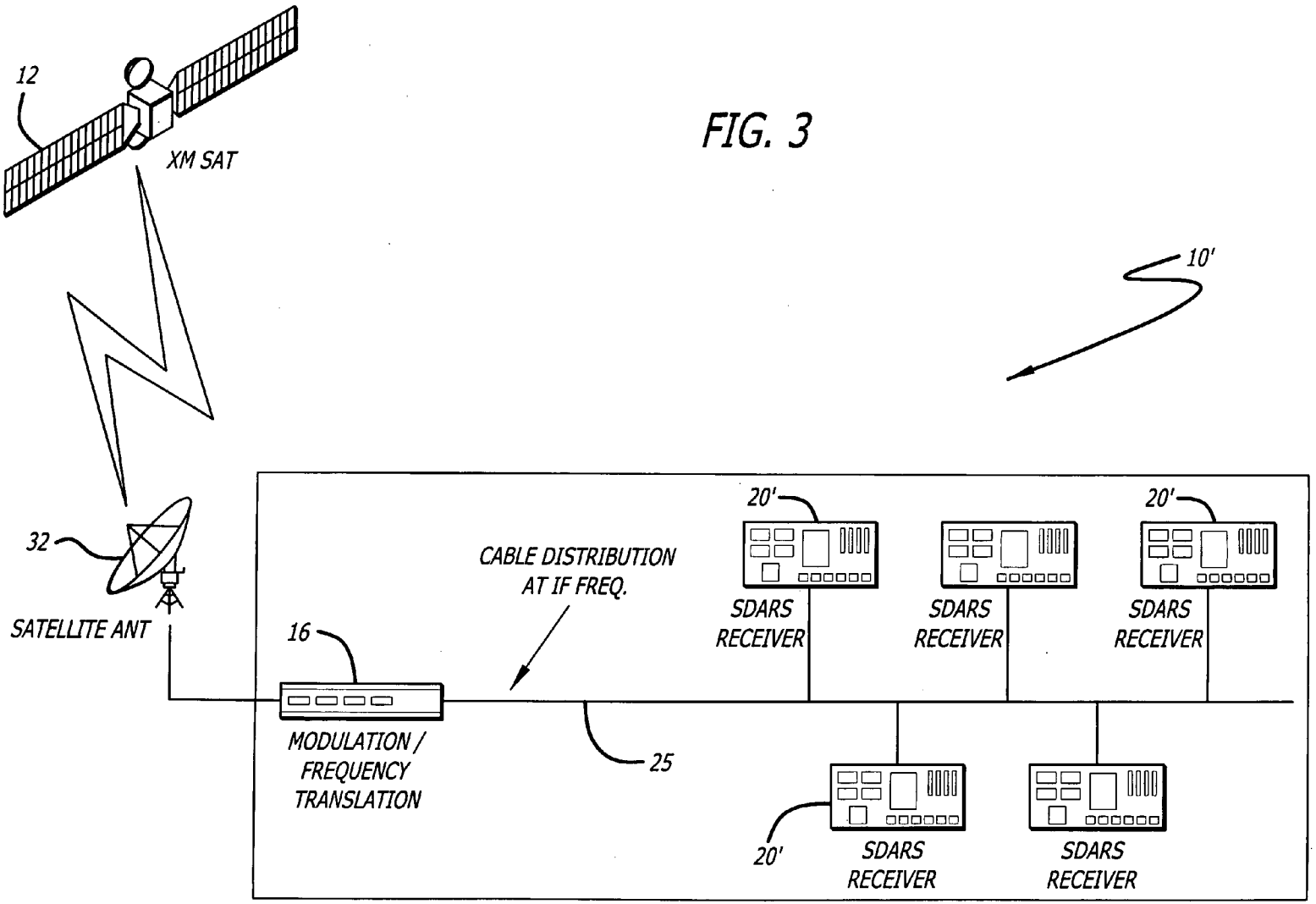
FIG. 3 illustrates the satellite digital audio radio service multi-point distribution system architecture of the present invention.

FIG. 3 illustrates the satellite digital audio radio service multi-point distribution system architecture of the present invention. The system 10' includes an antenna 32 for receiving a signal transmitted by the satellite 12. Depending on the application, the antenna 32 may be mounted on an airliner, an office building, an apartment building, or any suitable structure within which or from which multipoint distribution of a receive satellite signal is desired.

In the best mode, the RF signal received by the antenna 32 is provided to a terrestrial repeater 16 which decodes the received satellite data stream and recodes it using an XM radio terrestrial broadcast multi-carrier (MCM) format. MCM is a preferred modulation scheme. The provision of a guard interval with MCM mitigates ISI (inter-symbol interference). With MCM, relatively few carriers will be affected by fading. Accordingly, MCM secures transmission in mobile reception scenarios and is therefore ideally suited for the task of terrestrial re-broadcasting. Nonetheless, those skilled in the art will appreciate that the invention is not limited to the coding and decoding scheme disclosed herein. Other coding schemes may be used without departing from the scope of the present teachings.

The terrestrial repeater 16 is implemented as shown in FIG. 2. The output of the repeater 16 is an intermediate frequency (IF) signal in the defined XM radio terrestrial broadcast MCM format. This MCM reformatted signal is transported at the terrestrial IF frequency via a network 25 to multiple points within a desired service area. As will be appreciated by those skilled in the art, the distribution network 25 may be wireless, cable, fiber-optic, etc.

At each reception point, a receiver 20' is provided. As discussed more fully below, each receiver 20' is a modified SDARS receiver which provides a separate user interface to allow for channel selection and audio processing. Consequently, each receiver may be tuned to a separate channel to provide audio and/or visual output.

Figure 4:
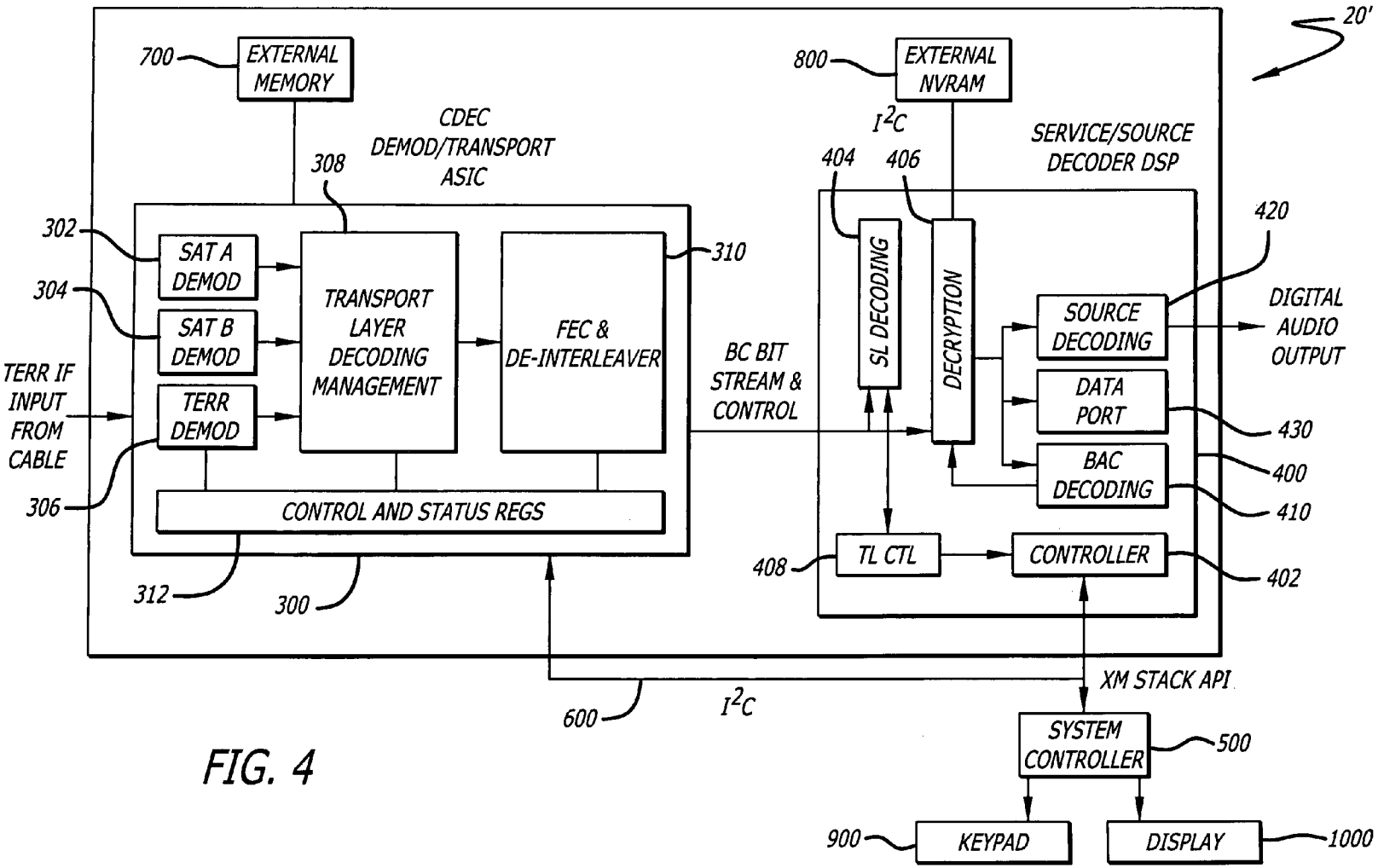
FIG. 4 is a block diagram of an illustrative implementation of the multipoint SDARS receiver constructed in accordance with the teachings of the present invention.

FIG. 4 is a block diagram of an illustrative implementation of the multipoint SDARS receiver 20' constructed in accordance with the teachings of the present invention. With the exceptions of the modifications disclosed herein, in the preferred embodiment, the receiver 20' is an XM satellite receiver such as that disclosed and claimed in copending U.S. patent applications entitled LOW COST INTEROPERABLE SATELLITE DIGITAL AUDIO RADIO SERVICE (SDARS) RECEIVER ARCHITECTURE, filed May 25, 1999 by P. Marko et al., Ser. No. 09/318,296, (Atty. Docket No. XM 0006) and SATELLITE DIGITAL AUDIO RADIO SERVICE RECEIVER ARCHITECTURE FOR RECEPTION OF SATELLITE AND TERRESTRIAL SIGNALS, filed Nov. 4, 1999 by P. Marko et al., Ser. No. 09/435,317, (Atty. Docket No. XM 0003) the teachings of both of which are hereby incorporated herein by reference.

As illustrated in FIG. 4, and in accordance with the present teachings, the antenna modulate and RF tuner module are eliminated. Accordingly, each receiver 20' includes a channel decoder 300, a source decoder 400, a system controller 500, and $I^2C$ bus 600, an audio output circuit (not shown), a keypad 900, and a display 1000. An external memory 700 serves the channel decoder 300 and external non-volatile random access memory 800 serves the source decoder 400.

The channel decoder 300 is shown as having first and second demodulators for satellite A and satellite B, 302 and 304, respectively. However, in accordance with the present teachings, these elements would not be utilized in the receiver 20'. The demodulator's 302 and 304 are shown to illustrate that a receiver 20' of otherwise conventional design may be utilized in the multipoint distribution system 10' of the present invention.

The IF signal received from the terrestrial repeater 16 is demodulated by a terrestrial demodulator 306. As discussed more fully below, the terrestrial demodulator 306 performs multi-carrier (MCM) demodulation and synchronization on the received signal before providing it to a time division demultiplexer 308' for transport layer decoding management.

Figure 5:
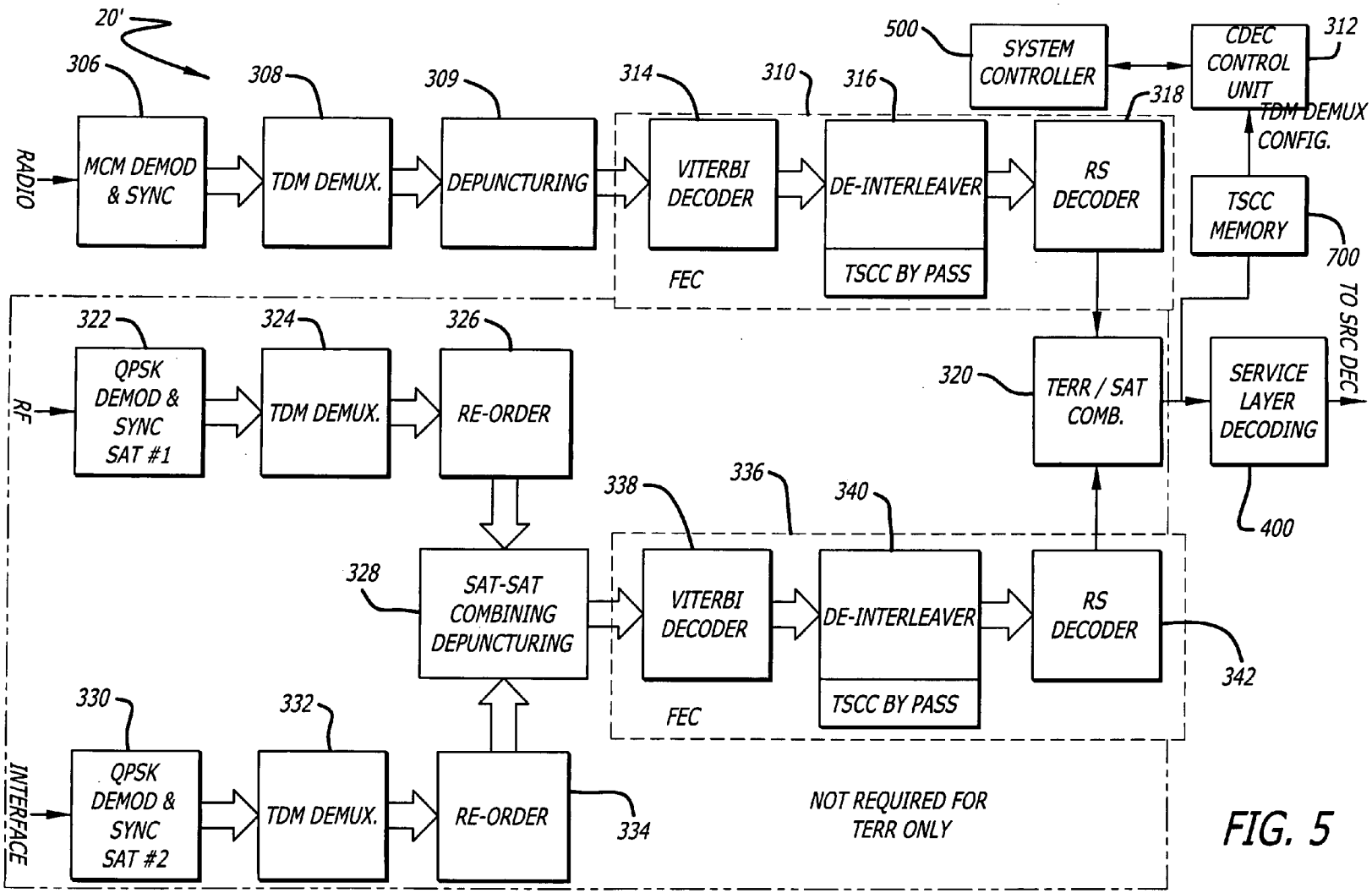
FIG. 5 is a functional block diagram illustrating the multipoint receiver of FIG. 4 in detail.

As shown in FIG. 5, the time-division demultiplexed signal is depunctured and applied to a toward error correcting circuit 310. As is well known in the art, depuncturing involves a selective removal of bits associated with a Viterbi encoded word. The output of the depuncturing circuit 309 is input to a Viterbi decoder 314 in the forward error correcting circuit 310. Thereafter, the received signal is Viterbi decoded, deinterleaved (316), and Reed-Solomon decoded (318). Multi-carrier modulation, time-division demultiplexing, depuncturing, Viterbi decoding, de-interleaving and Reed-Solomon decoding are well known in the art.

The output of the Reed-Solomon decoder 318 is provided via a terrestrial/satellite combiner 320 to the source decoder 400 for service layer decoding. In accordance with present teachings, the satellite A and B signals are not present, accordingly, the terrestrial/satellite combiner 320 is not required and is provided merely to show that a satellite digital audio radio receiver of conventional design may be utilized to practice the teachings of the present invention.

The output of a combiner 320 is also provided to a TSCC memory 700. The memory 700 provides time-division demultiplexing configuration data to a channel decoder control unit 312. The channel decoder control unit 312 consists of a number of control and status registers and operates under control of the system controller 500.

Returning to FIG. 4, a user interface is provided via a keypad 900 and a display 1000. The user inputs are utilized by the system controller 500 to provide control signals to the channel decoder control unit 312 and the source decoder control unit 402 via an $I^2C$ bus 600: $I^2C$ buses are well known in the art. $I^2C$ transmitter and receiver hardware and software may be acquired from the Phillips Cord. for example.

By loading an appropriate control word in a control register in the control unit 312 of the channel decoder 300, the system controller effectively configures the channel decoder so that is processes only the terrestrial input received through the demodulator 306.

The source decoder 400 receives a BC (Broadcast Channel) bitstream and control signals from the channel decoder 300 and performs service layer decoding in an SL decoder 404 and decryption in a decrypting circuit 406 in the manner disclosed in the above-referenced patents filed by P. Marko et al., the teachings of which have been incorporated herein by reference. (As is known in the art, the 'Broadcast Channel' is a dedicated TDM stream consisting of a logical grouping of TDM multiplex prime rate channel packets. The Broadcast Channel carries all the information required to demultiplex the TDM stream.) Service layer decoding is facilitated through use of information carried in the Broadcast Information Channel by a control word is stored in a transport layer control register 408 by the system controller to determine which broadcast channels are demultiplexed. Decryption is facilitated by an encryption key provided by a broadcast authorization channel decoder 410. The decryption is required inasmuch as the satellite signals are transmitted in an encrypted form to limit authorized access.

The decrypted signals are provided to an audio source decoder 420 and a data port 430. The audio source decoder 420 is configured to provide an analog or digital output signal depending upon the application as will be appreciated by those of ordinary skill in the art. The data port 430 is configured to provide digital output data such as may be appropriate for a visual display or any external data device, e.g., laptop.

Those skilled in the art will appreciate that one benefit of using the MCM level, in accordance with present teachings, is that the terrestrial carrier is not deeply interleaved. This lowers the memory requirements for the system.

Thus, the present invention has been described herein with reference to a particular embodiment for a particular application. Those having ordinary skill in the art and access to the present teachings will recognize additional modifications, applications and embodiments within the scope thereof. For example, as an alternative to the repeater, satellite radio signals may be stored in a medium such as a digital video disc and rebroadcast therefrom as disclosed and claimed in copending U.S. patent application Ser. No. 09/463,862 filed Nov. 4, 1999 by C. Wadin and P. Marko and entitled Composite Waveform Storage and Playback (Atty Docket #39253) the teachings of which are incorporated herein by reference.

It is therefore intended by the appended claims to cover any and all such applications, modifications and embodiments within the scope of the present invention.

Accordingly,

What is claimed is:

1. A satellite digital audio radio multipoint distribution system comprising:

a satellite antenna for receiving a satellite digital audio radio signal;

a terrestrial repeater connected to said antenna for decoding said satellite signal and recoding said signal into an XM radio terrestrial intermediate frequency (IF) multi-carrier modulated satellite radio terrestrial broadcast format signal, said repeater including:

a receiver and demodulator for down-converting the satellite digital audio radio signal to a TDM bitstream, a de-interleaver and reformatter for re-ordering the TDM bitstream for a terrestrial waveform, a terrestrial waveform modulator coupled to said de-interleaver and reformatter, and means for recording the output of said modulator to an IF frequency;

a system for distributing said recoded IF signal, and plural satellite digital audio radio service receivers adapted to receive said recoded IF signal from said distributing system and provide an audio or visual output signal in response thereto.

2. The invention of claim 1 wherein each of said plurality receivers includes a respective user interface to allow for channel selection and audio processing.

3. The invention of claim 1 wherein each of said plural receivers includes a channel decoder integrated circuit adapted to receive said recoded signal and provided a digital bitstream output in response thereto.

4. The invention of claim 3 wherein each of said plural receivers further includes a source decoder digital signal processor adapted to receiver said digital bitstream and provide said output signal in response thereto.

5. The invention of claim 1 wherein said distribution system is a cable distribution system.

6. The invention of claim 1 wherein said distribution system is a wireless distribution system.

7. The invention of claim 1 wherein said distribution system is a fiber-optic distribution system.

8. The invention of claim 1 wherein said output signal is an audio output signal.

9. The invention of claim 1 wherein said satellite antenna, terrestrial repeater, system for distributing, and plural receivers are mounted on a single structure.

10. The invention of claim 9 wherein said structure is mobile.

11. A method for distributing a satellite digital audio radio signal to multiple receivers including the steps of:

receiving a satellite digital audio radio signal and distributing an XM radio terrestrial intermediate frequency (IF) multi-carrier modulated recoded signal in response thereto using a repeater comprising:

a receiver and demodulator for down-converting the satellite digital audio radio signal to a TDM bitstream, a de-interleaver and reformatter for re-ordering the TDM bitstream for a terrestrial waveform, a terrestrial waveform modulator coupled to said de-interleaver and reformatter, and means for recording the output of said modulator to an IF frequency and receiving said distributed recoded signal via plural receivers and providing plural output signals in response thereto.

12. The invention of claim 11 wherein said steps of:

receiving a satellite digital audio radio signal and distributing an XM radio terrestrial intermediate frequency (IF) multi-carrier modulated recoded signal in response thereto and receiving said distributed recoded signal via plural receivers are performed on a single structure.

13. The invention of claim 12 wherein said structure is mobile.

14. A satellite digital audio radio multipoint distribution system comprising:

a satellite antenna for receiving a satellite digital audio radio signal;

a terrestrial repeater connected to said antenna for decoding said satellite signal and recoding said signal into an XM radio terrestrial intermediate frequency (IF) multi-carrier modulated satellite radio terrestrial broadcast format signal, said repeater including:

a receiver and demodulator for down-converting the satellite digital audio radio signal to a TDM bitstream, a de-interleaver and reformatter for re-ordering the TDM bitstream for a terrestrial waveform, a terrestrial waveform modulator coupled to said de-interleaver and reformatter, and means for recoding the output of said modulator to an IF frequency; and a system for distributing said recoded IF signal.

15. The invention of claim 14 wherein said satellite antenna, terrestrial repeater, and system for distributing are mounted on a single structure.

16. The invention of claim 15 wherein said structure is mobile.

* * * * *